US006331153B1

(12) United States Patent
McClellan

(10) Patent No.: US 6,331,153 B1
(45) Date of Patent: Dec. 18, 2001

(54) PORTABLE LEG EXERCISING DEVICE

(76) Inventor: Robert T. McClellan, 3385 Yolanda, Springfield, OR (US) 97477

( * ) Notice: Subject to any disclaimer, the term of this patent is extended or adjusted under 35 U.S.C. 154(b) by 0 days.

(21) Appl. No.: 09/593,379

(22) Filed: Jun. 12, 2000

(51) Int. Cl.[7] ..... A63B 22/04; A63B 69/16
(52) U.S. Cl. ..... 482/52; 482/57
(58) Field of Search ..... 482/52, 51, 57, 482/53, 60, 70, 61, 148; 601/23, 27, 28, 34, 35, 36

(56) References Cited

U.S. PATENT DOCUMENTS

| | | | |
|---|---|---|---|
| D. 348,492 | 7/1994 | Konatski, II . | |
| 4,946,162 | 8/1990 | Lubie . | |
| 5,180,351 * | 1/1993 | Ehrenfried | 482/52 |
| 5,279,530 | 1/1994 | Hess . | |
| 5,295,928 | 3/1994 | Rennex . | |
| 5,299,995 | 4/1994 | Ko . | |

FOREIGN PATENT DOCUMENTS

| | | | |
|---|---|---|---|
| 2012599A * | 8/1978 | (GB) | 23/4 |

* cited by examiner

*Primary Examiner*—Stephen R. Crow
(74) *Attorney, Agent, or Firm*—Robert E. Howard

(57) ABSTRACT

A portable leg exercising device including a frame having a top, bottom, and two sides. An upper roller subassembly is rotatably positioned adjacent the top of the frame, and a lower roller subassembly is rotatably positioned adjacent the bottom of the frame. A continuous belt extends around and between the two roller subassemblies. Pedal subassemblies are attached to opposite sides of the belt to permit a user to place their feet therein and to alternately push down against the pedals with their feet.

13 Claims, 4 Drawing Sheets

PORTABLE LEG EXERCISING DEVICE

BACKGROUND OF THE INVENTION

This invention relates to a portable leg exercising device, particularly one that is compact enough to be used while traveling in a vehicle, airplane or train.

The diverse types of leg exercising devices currently available in commercial gymnasiums are truly astounding. There are typically more than one type of machine available for exercising each specific muscle of the leg. These machines are large and, therefore, not portable; they are also very expensive.

There have been several suggestions in the prior art of leg exercising devices characterized as "portable". However, these devices occupy substantial horizontal space and often require that the user lay on the floor. See, for example, U.S. Pat. No. 5,279,530.

Even where the user can sit in a chair some such devices still occupy substantial horizontal space. See, for example, U.S. Pat. No. 4,946,162.

U.S. Pat. No. 5,299,995 describes a leg exercising device that can be used while sitting in a chair at a desk. While the device is more compact than many other "portable" leg exercising devices, it is not clear that the device is intended to be carried about, and the construction of the device is complicated.

SUMMARY OF THE PRESENT INVENTION

It is an object of the present invention to provide a leg exercising device that is truly portable, i.e., can be easily carried about, and can be used by persons while traveling in automobiles, airplanes, buses, trains, etc.

It is a further object of the present invention to provide a leg exercising device that is simple and inexpensive to construct.

The portable leg exercising device of the present invention includes a frame having a top, bottom, and two sides. An upper roller subassembly is rotatably positioned adjacent the top of the frame, and a lower roller subassembly is rotatably positioned adjacent the bottom of the frame. A continuous belt extends around and between the two roller subassemblies. Pedal subassemblies are attached to opposite sides of the belt to permit a user to place their feet therein and to alternately push down against the pedals with their feet.

DESCRIPTION OF PREFERRED EMBODIMENTS

Figure 1:
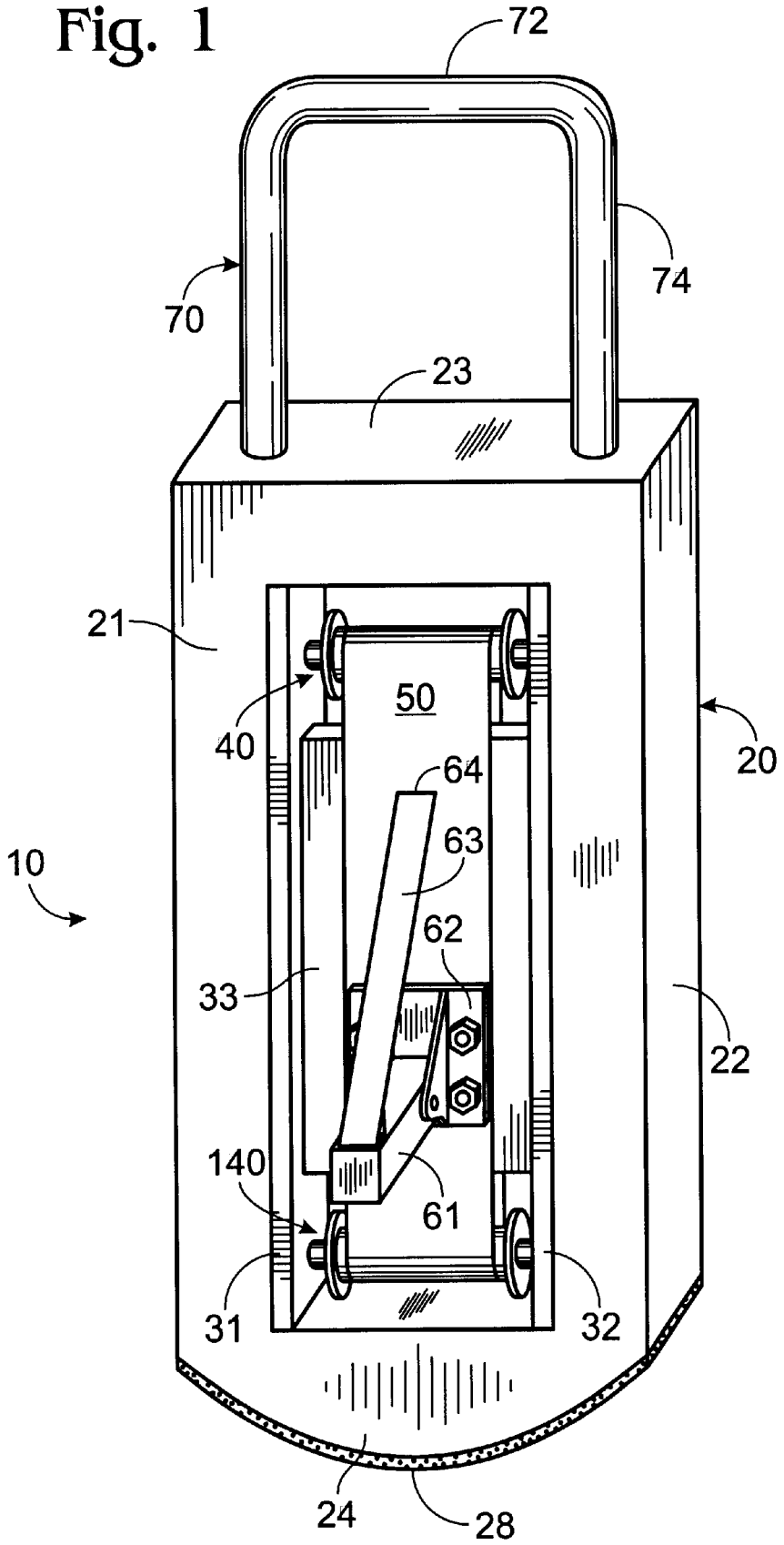
FIG. 1 is a perspective side view of the leg exercising device of the present invention.

The leg exercising device 10 of the present invention has a frame subassembly 20 comprised of vertical side frame members 21 and 22, a horizontal top frame member 23, and a horizontal bottom frame member 24. Frame 20 can be made of plastic and molded so that all of the frame members are integral.

Alternatively, the various frame members 21–24 of frame subassembly 20 could be individual pieces that are attached to each other by suitable attachment means, such as by screws.

The inner edges of frame members 21–24 define an opening 25. At the rear of the inner edges of vertical side frame members 21 and 22 are attached stop members 26, only the one attached to side frame member 21 being shown.

Cylindrical passageways 27 extend longitudinally downward inside side frame members 21 and 22, respectively.

Bottom frame member 24 preferably has an outer surface that is convex in shape, as shown. The outer surface of frame member 24 may be covered with a non-skid material 28, such as a rubber pad.

Figure 3:
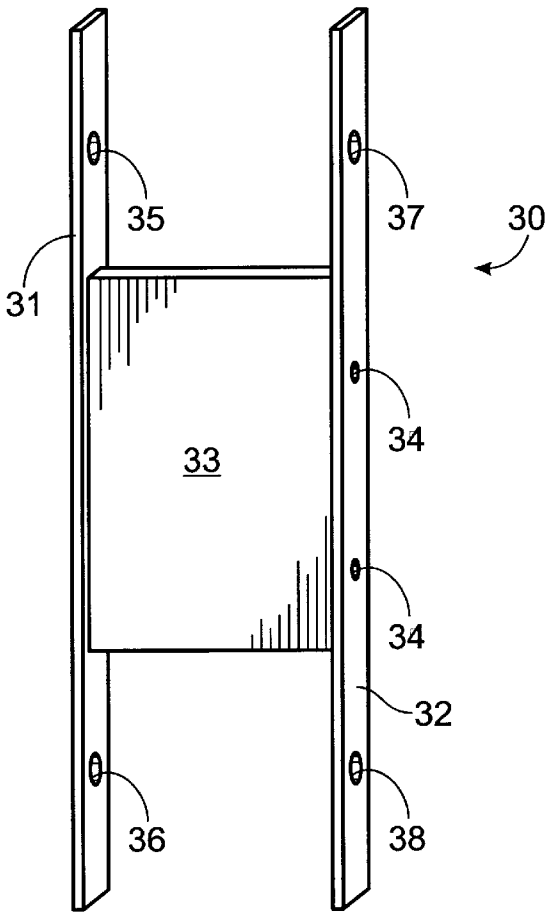
FIG. 3 is a perspective side view of the roller and belt support subassembly.
Figure 2:
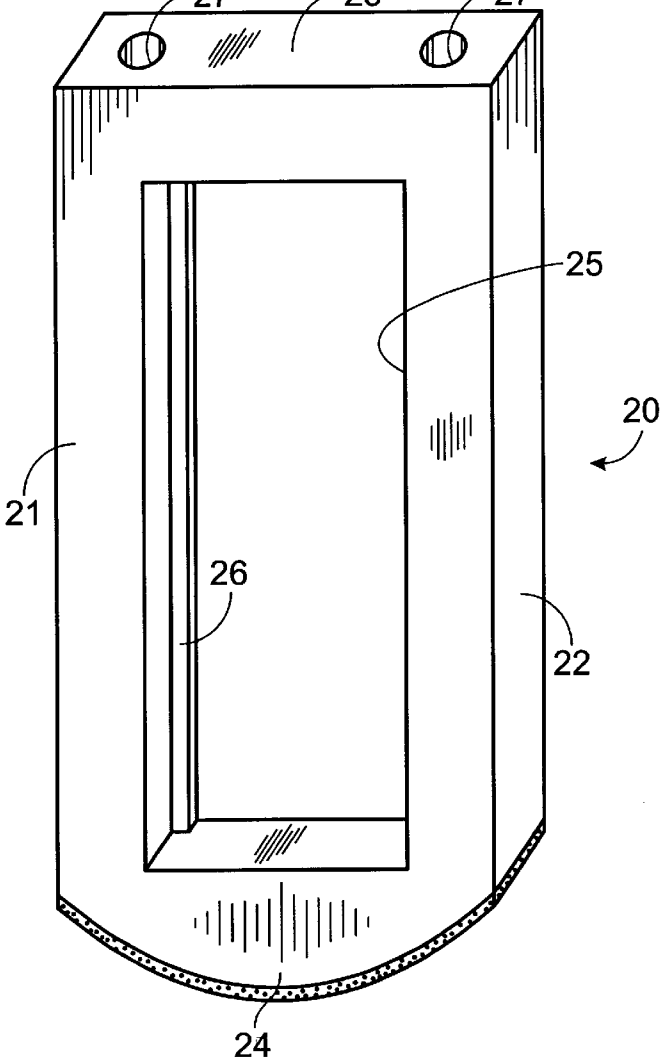
FIG. 2 is a perspective side view of the frame subassembly of the leg exercising device of the present invention.

A roller and belt support subassembly 30 is shown in FIG. 3. Support subassembly 30 is comprised of two substantially parallel legs 31 and 32 connected to cross bar 33 by any suitable means such as screws 34. Extending through leg 31 are upper and lower roller axle receiving openings 35 and 36, respectively. Extending through leg 32 are upper and lower axle receiving openings 37 and 38, respectively.

Figure 5:
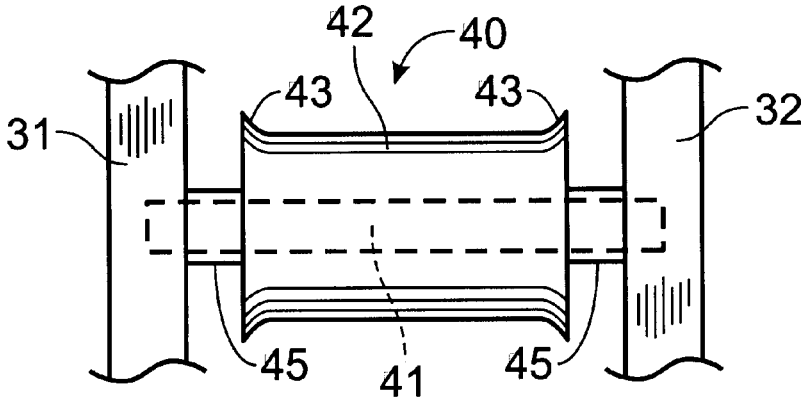
FIG. 5 is a side view of the upper roller subassembly of the leg exercising device of the present invention.

Leg exercising device 10 has upper and lower roller subassemblies 40 and 140, respectively. Upper roller subassembly 40 is illustrated in FIG. 5. Lower roller subassembly 140 is identical in construction to upper roller subassembly 40, and parts of lower roller subassembly 140 identical to parts of upper roller subassembly 40 have the same reference number but increased by 100.

An axle 41 is seated at one end in axle receiving opening 35 of leg 31 and seated at its other end in axle receiving opening 37 of leg 32. A ball bearing roller (or plastic self lubricating roller) 42 is rotatably mounted on axle 41. Flanges 43 extend from both ends of roller 42, thereby providing a belt stop at each end of roller 42. Cylindrical spacer members 45 are located adjacent each end of axle 41 between side frame members 21 and 22 and roller 42. Spacer members 45 keep roller 42 centered on axle 41.

Figure 4:
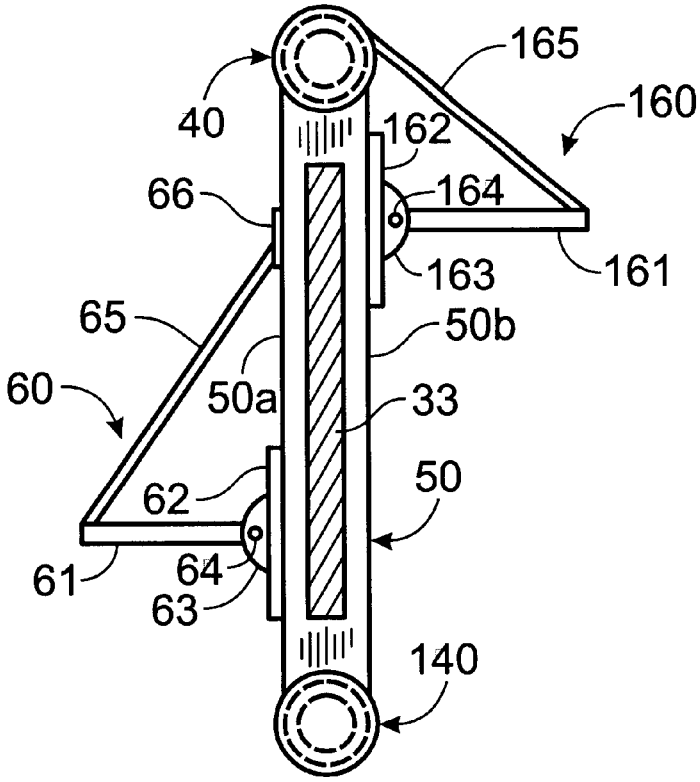
FIG. 4 is a front view, partially in cross-section, of the roller, belt and pedal subassemblies of the leg exercising device of the present invention.

A rotatable continuous belt 50 extends between upper and lower roller subassemblies 40 and 140. Belt 50 is wrapped around rollers 42 and 142, between belt stop flanges 43 and 143, of upper and lower roller subassemblies 40 and 140, respectively. The two portions 50*a* and 50*b* of belt 50 extending between upper and lower roller subassemblies 40 and 140 are substantially parallel. Cross bar member 33 has a thickness such that portions 50*a* and 50*b* of belt 50 are spaced therefrom, as best seen in FIG. 4.

Pedal subassemblies 60 and 160 are attached to the outer surface of belt 50. Pedal subassembly 60 is attached to portion 50*a* of belt 50 and pedal subassembly 160 is attached to portion 50*b* of belt 50. Pedal subassemblies 60 and 160 are attached to belt 50 at positions that would be 180 degrees apart if belt 50 were arranged in a circular configuration. Stated another way, pedal subassemblies 60 and 160 are opposite each other when at a location substantially midway between upper and lower roller subassemblies 40 and 140.

Pedal subassemblies 60 and 160 are identical in construction, and parts of pedal subassembly 160 that are illustrated and are identical to parts of pedal subassembly 60 are identified by the same reference number but increased by 100. Only pedal subassembly 60 will be specifically discussed, it being understood that the same discussion applies to pedal subassembly 160.

Referring to pedal subassembly 60, a foot peg 61 is pivotally attached at its inner end to belt fastening plate 62 in any suitable manner, such as by positioning foot peg 61 between ears 63 extending from plate 62 and fastening a pin member 64 therethrough. Belt fastening plate 62 is attached to belt 50 in any suitable manner, such as by use of nuts and bolts. During transport or storage of device 10, foot peg 61 is folded upwardly against belt 50.

The outer end of foot peg 61 is attached to one end of a strap member 65. The other end of strap member 65 is attached to strap fastening plate 66. Strap fastening plate 66 is attached to belt 50 in any suitable manner, such as by use of nuts and bolts. The space between strap member 65 and foot peg 61 must be sufficient to permit a user to place his foot therein.

In assembling the device 10 of the invention, rollers 40 and 140, and belt 50, are fixed into place in subassembly 30, and subassembly 30 inserted into opening 25 of frame subassembly 20 until legs 31 and 32 abut stop members 26. Legs 31 and 32 are fastened to side frame members 21 and 22, respectively, by suitable attachment means such as screws.

A handle 70 has a horizontal hand grip portion 72 and two vertical legs 74 extending downwardly and perpendicularly therefrom. Legs 74 are inserted into handle receiving openings 27 and 28 located in side frame members 21 and 22, and are adapted to be movable within openings 27 and 28 from a closed position where grip 72 is substantially in contact with top frame member 23 to an open or extended position where grip 72 is spaced apart from top frame member 23. The handle is adapted to extend outwardly a limited distance sufficient to be held by the hand or hands of a user for exercising the user's legs, and to be locked into position when in the closed position. The mechanism for accomplishing these features form no part of the present invention as they are well known in the luggage art.

Although the invention is clearly not limited to specific dimensions, it has been found that certain dimensions are satisfactory in achieving the objects of portability, compactness, and ease and expense of manufacture. As a specific example, a distance between top frame member 23 and bottom frame member 24 of about 24 inches achieves the desired compactness. Handle grip 72 desirably can be extended above top frame member 23 a maximum distance of about 12 inches. A belt 50 having a width of about 2 inches, a thickness of between about ⅜ inch and about ¼ inch, and a total length of about 36 inches to about 40 inches is satisfactory to provide good leg exercising ability. Foot peg 61 preferably has a length of about 6 inches, a width of about ¾ inch, and a thickness of about ¾ inch. Strap members 63 and 163 preferably have a length of about 10 inches, a width of about one inch, and a thickness of about 1/16 inch, and can be made of nylon.

In operation, the user places bottom frame member 24 on the floor and extends handle 70 outwardly. The user pulls down foot pegs 61 and 161 from their vertical, stored position to a position substantially perpendicular to belt 50, as shown in FIG. 1. The user then places his or her left foot onto foot peg 61 and underneath strap 63 and right foot onto foot peg 161 and underneath strap 163. The user holds onto handle 70 during exercising. Because of the convex shape of bottom frame member 24, the user can easily adjust the inclination of device 10 relative to the vertical, i.e., by pulling handle 70 toward the user, until an inclined position is found that is comfortable for exercising. Exercising is accomplished by the user alternately pushing downwardly against foot pegs 61 or 161 with the left or right foot, respectively. Pushing downwardly on foot peg 61 causes foot peg 161 to rise, and vice versa. As the lowest reach of pedal subassembly 60 is approached, the upper end of strap 165 of pedal subassembly 160 passes over roller 42 of upper roller subassembly 40, as shown in FIG. 3.

Figure 6:
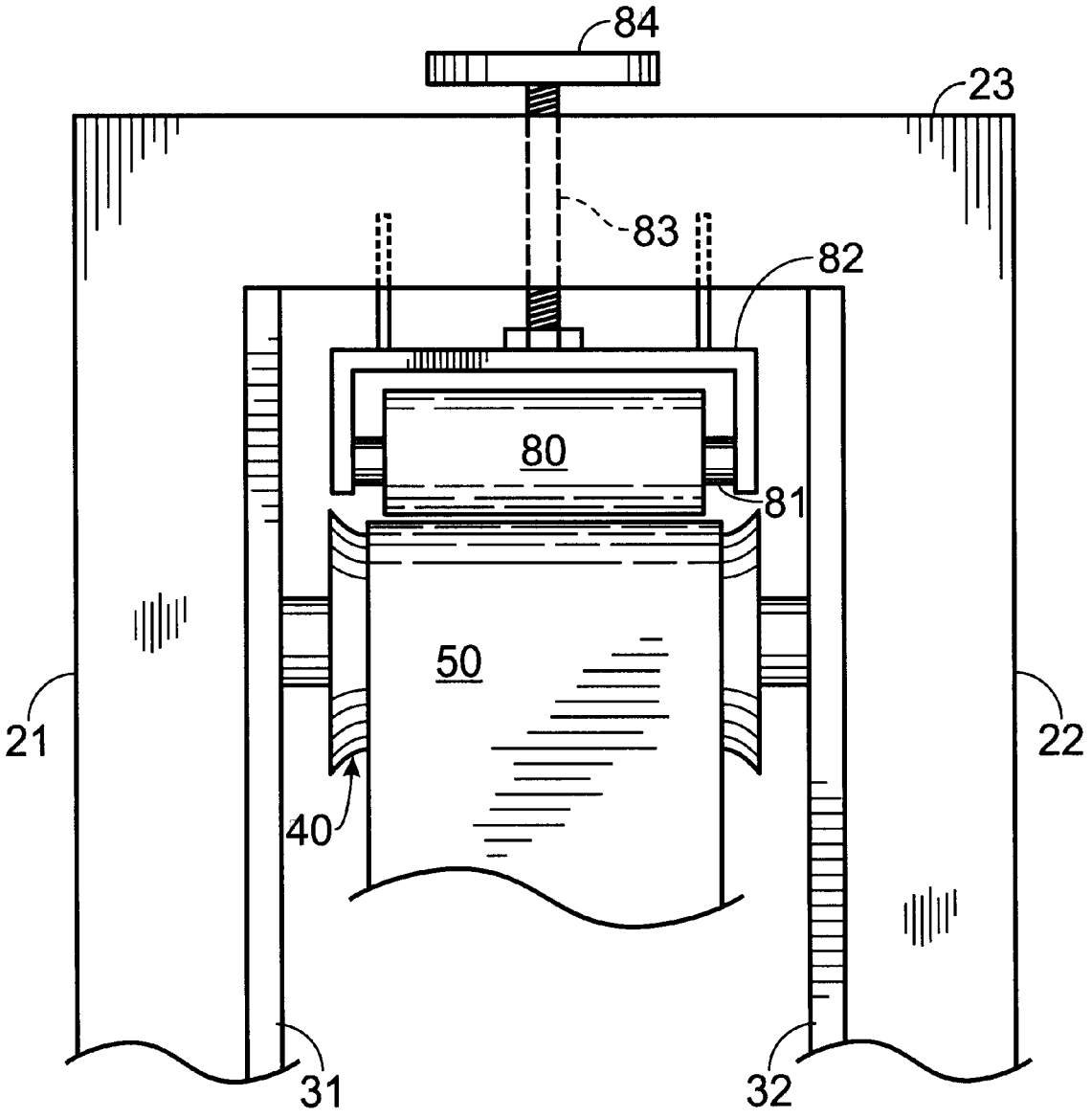
FIG. 6 is an alternative embodiment of the bottom of the leg exercising device of the present invention.

Resistance to downward motion of one foot can be supplied by the user applying some downward pressure with the other foot that is being raised. Alternatively, means can be employed to adjust the resistance to rotation of upper and/or lower roller subassemblies 40 and 140. One such means is illustrated in FIG. 6 wherein a resistance roller 80 on an axle 81 is rotatably attached to an adjustable frame 82. Frame 82 may be moved vertically up and down by means of screw 83 having a handle 84. Screwing frame 82 down towards belt 50 brings roller 80 into contact therewith adding resistance against movement of belt 50 around roller 40. Resistance against rotation of roller 80 around its axle 81 can be built in.

It will be obvious to those skilled in the art that changes may be made to the details of the described invention without departing from the underlying principles thereof. The scope of the present invention should, therefore, be determined only by the following claims.

The invention claimed is:

1. A portable leg exercising device comprising:

a frame having a top, bottom, and two sides;

an upper roller subassembly including an upper roller rotatably positioned adjacent said top of said frame;

a lower roller subassembly including a lower roller rotatably positioned adjacent said bottom of said frame;

a continuous belt extending around and between said upper and lower rollers; and first and second pedal subassemblies each comprising a foot peg attached to said belt at respective first and second locations on the outer surface of said belt that are opposite to each other when said pedal subassemblies are located substantially midway between said upper and lower roller assemblies, and two strap members attached to said belt and a respective foot peg.

2. The device of claim 1 wherein said frame is comprised of a top frame member, a bottom frame member, and two side frame members, said top, bottom and side frame members being attached to each other in a manner such that the inner edges of said frame members form a generally rectangular opening.

3. The device of claim 2 wherein said frame members are an integral unit.

4. The device of claim 1 wherein said upper and lower roller subassemblies are attached to a roller support subassembly and said roller support subassembly is located within said opening in said frame and attached to said inner edges of said side frame members.

5. The device of claim 4 wherein said roller support subassembly includes two substantially parallel legs and a cross bar frame member extending between said legs and attached thereto.

6. The device of claim 1 wherein said bottom of said frame has an outer surface that is convex.

7. The device of claim 1 wherein the outer surface of said bottom of said frame is adapted to be slip resistant.

8. The device of claim 6 wherein the outer surface of said bottom of said frame is adapted to be slip resistant.

9. The device of claim 1 including a handle extendable from the top of said frame.

10. The device of claim 1 including means to apply resistance to movement of said belt.

11. The device of claim 10 wherein said means to apply resistance includes a roller that can be pushed against said belt.

12. The device of claim 1 wherein said upper and lower rollers are ball bearing rollers.

13. The device of claim 1 wherein said upper and lower rollers are a plastic self-lubricating roller.

* * * * *